US011640785B1

(12) United States Patent
Wu et al.

(10) Patent No.: US 11,640,785 B1
(45) Date of Patent: May 2, 2023

(54) PIXEL DRIVING DEVICE

(71) Applicant: AU Optronics Corporation, Hsin-Chu (TW)

(72) Inventors: Chia-En Wu, Hsin-Chu (TW); Ming-Hsien Lee, Hsin-Chu (TW); Shu-Han Chang, Hsin-Chu (TW); Chun-Shiang Dai, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 17/841,701

(22) Filed: Jun. 16, 2022

(30) Foreign Application Priority Data

Jan. 5, 2022 (TW) ..... 111100471

(51) Int. Cl.
*G09G 3/32* (2016.01)

(52) U.S. Cl.
CPC ..... *G09G 3/32* (2013.01); *G09G 2300/0809* (2013.01); *G09G 2310/08* (2013.01); *G09G 2320/0233* (2013.01); *G09G 2360/145* (2013.01)

(58) Field of Classification Search
CPC ..... G09G 3/32; G09G 2300/0809; G09G 2310/08; G09G 2320/0233; G09G 2360/145
See application file for complete search history.

(56) References Cited

U.S. PATENT DOCUMENTS

2019/0035326 A1 1/2019 Wang et al.
2021/0173544 A1* 6/2021 Yang ..... G06F 3/04166
2021/0407379 A1 12/2021 Yang et al.

FOREIGN PATENT DOCUMENTS

CN 108154844 A 6/2018

* cited by examiner

*Primary Examiner* — Gene W Lee
(74) *Attorney, Agent, or Firm* — WPAT, PC

(57) ABSTRACT

A pixel driving device includes a driving transistor, a pixel driving circuit, an optical sensor circuit, and a reset and reading circuit. Driving transistor controls a light emission device. Pixel driving circuit is connected to the driving transistor and resets according to a first sweep signal. Pixel driving circuit compensates according to a second sweep signal. Pixel driving circuit controls the driving transistor according to a driving signal to drive light emission device. Optical sensor circuit includes a node. Optical sensor circuit resets the node to a voltage level of the driving signal. Light sensing circuit performs sensing to generate a light sensing signal. Reset and reading circuit is connected to the driving transistor, the pixel driving circuit, and the optical sensor circuit. Reset and reading circuit receives a reset and reading signal so as to reset the pixel driving circuit and to read out the light sensing signal.

20 Claims, 9 Drawing Sheets

PIXEL DRIVING DEVICE

RELATED APPLICATION

This application claims priority to Taiwan Application Serial Number 111100471, filed on Jan. 5, 2022, which is herein incorporated by reference in its entirety.

BACKGROUND

Field of Invention

The present disclosure relates to an electronic device. More particularly, the present disclosure relates to a pixel driving device.

Description of Related Art

In conventional pixel driving devices, threshold voltages of driving transistors are different, resulting in current differences, which in turn lead to brightness differences and uneven display images of pixel driving devices.

In addition, a driving current required for micro light emitting devices (μ LED) in conventional pixel driving devices to emit light is relatively large. When a driving current flows through a path between two power supply voltages, a voltage difference is too large to generate a driving current difference, which in turn lead to differences in brightness and increased power consumption of a pixel driving device.

Furthermore, based on a structure of conventional pixel driving device, if an optical sensor is added to a pixel driving device, a pixel driving device will be too complicated and difficult to implement.

For the foregoing reason, there is a need to provide some other circuits to solve the problems of the prior art.

SUMMARY

One aspect of the present disclosure provides a pixel driving device. The pixel driving device includes a driving transistor, a pixel driving circuit, an optical sensor circuit, and a reset and reading circuit. A first end of the driving transistor is connected to a first node. A control end of the driving transistor is connected to a second node. The driving transistor is configured to control a light emitting device. The pixel driving circuit is connected to the driving transistor, the first node, and the second node, and is configured to receive a first sweep signal, a second sweep signal, and a driving signal. The pixel driving circuit is configured to reset the first node and the second node according to the first sweep signal. The pixel driving circuit is configured to compensate the second node according to the second sweep signal. The pixel driving circuit is configured to control the driving transistor so as to drive the light emitting device according to the driving signal. The optical sensor circuit includes a third node. The optical sensor circuit is configured to receive the driving signal to reset the third node to a voltage level of the driving signal. The optical sensor circuit is configured to perform a sensing process to generate a light sensing signal. The reset and reading circuit is connected to the pixel driving circuit, the optical sensor circuit, and the control end of the driving transistor. The reset and reading circuit is configured to receive a reset and reading signal so as to reset the pixel driving circuit and read out the light sensing signal of the optical sensor circuit at the same time.

Another aspect of the present disclosure provides a pixel driving device. The pixel driving device includes a driving transistor, a pixel driving circuit, and an optical sensor circuit. A first end of the driving transistor is connected to a first node. A control end of the driving transistor is connected to a second node. The driving transistor is configured to control a light emitting device. The pixel driving circuit is configured to receive a first sweep signal, a second sweep signal, a driving signal, and a reset and reading signal. The pixel driving circuit is configured to reset the first node and the second node according to the first sweep signal. The pixel driving circuit is configured to compensate the second node according to the second sweep signal. The pixel driving circuit is configured to control the driving transistor so as to drive the light emitting device according to the driving signal. The pixel driving circuit is configured to turn off the driving transistor according to the reset and reading signal. The optical sensor circuit is connected to the pixel driving circuit. The optical sensor circuit is configured to receive the driving signal and the reset and reading signal. The optical sensor circuit is configured to perform a sensing process so as to a light sensing signal. The optical sensor circuit is configured to output the light sensing signal to a readout line of the pixel driving device according to the reset and reading signal.

These and other aspects of the present disclosure will become apparent from the following description of the preferred embodiment taken in conjunction with the following drawings, although variations and modifications therein may be effected without departing from the spirit and scope of the novel concepts of the disclosure.

It is to be understood that both the foregoing general description and the following detailed description are by examples, and are intended to provide further explanation of the present disclosure as claimed.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
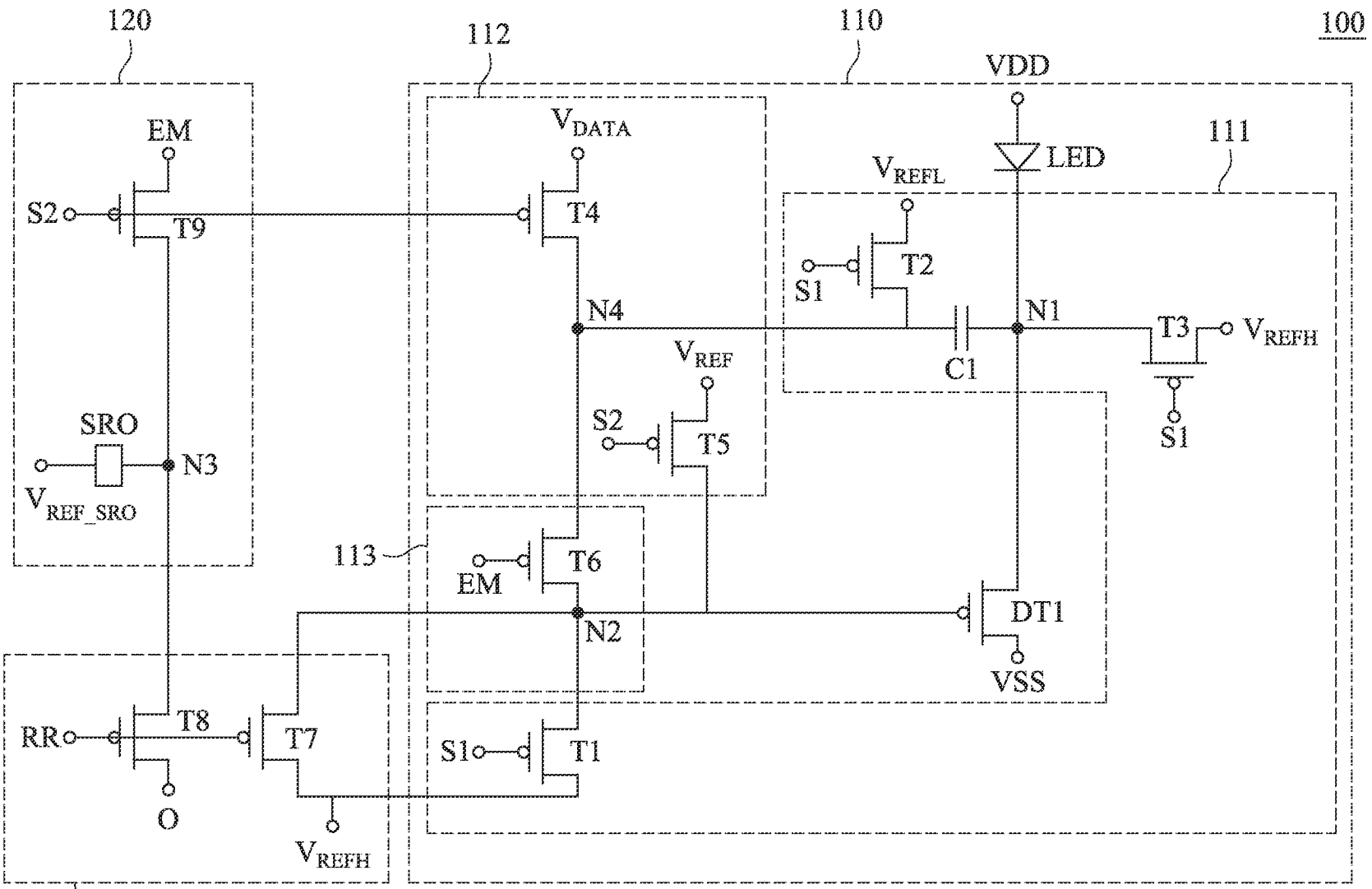
FIG. 1 depicts a schematic diagram of a pixel driving device according to some embodiments of the present disclosure.

Reference will now be made in detail to the present embodiments of the invention, examples of which are illustrated in the accompanying drawings. Wherever possible, the same reference numbers are used in the drawings and the description to refer to the same or like parts.

The terminology used herein is for the purpose of describing particular example embodiments only and is not intended to be limiting of the present disclosure. As used herein, the singular forms "a," "an" and "the" are intended to include the plural forms as well, unless the context clearly indicates otherwise.

Furthermore, it should be understood that the terms, "comprising", "including", "having", "containing", "involving" and the like, used herein are open-ended, that is, including but not limited to.

The terms used in this specification and claims, unless otherwise stated, generally have their ordinary meanings in the art, within the context of the disclosure, and in the specific context where each term is used. Certain terms that are used to describe the disclosure are discussed below, or elsewhere in the specification, to provide additional guidance to the practitioner skilled in the art regarding the description of the disclosure.

FIG. 1 depicts a schematic diagram of a pixel driving device 100 according to some embodiments of the present disclosure. In some embodiments, please refer to FIG. 1, the pixel driving device 100 includes a driving transistor DT1, a pixel driving circuit 110, an optical sensor circuit 120, and a reset and reading circuit 130.

In some embodiments, please start form a top end and a right end of each of an element shown in the figure as a first end. A first end of the driving transistor DT1 is connected to a first node N1. A control end driving transistor DT1 is connected to a second node N2. The driving transistor DT1 is configured to control a light emitting device LED. The pixel driving circuit 110 is connected to driving transistor DT1, the first node N1, the second node N2, and is configured to receive first sweep signal S1, a second sweep signal S2, and a driving signal EM.

Then, the pixel driving circuit 110 is configured to reset the first node N1 and the second node N2 according to the first sweep signal S1. The pixel driving circuit 110 is configured to compensate the second node N2 according to the second sweep signal S2. The pixel driving circuit 110 is configured to control the driving transistor DT1 so as to drive the light emitting device LED according to the driving signal EM.

Furthermore, the optical sensor circuit 120 includes a third node N3. The optical sensor circuit 120 is configured to receive the driving signal EM to reset the third node N3 to a voltage level of the driving signal EM.

The reset and reading circuit 130 is connected to the pixel driving circuit 110, the optical sensor circuit 120, and the control end of the driving transistor DT1. Then, the reset and reading circuit 130 is configured to receive a reset and reading signal RR so as to reset the pixel driving circuit 110 and read out the light sensing signal of the optical sensor circuit 120 at the same time.

In some embodiments, the pixel driving circuit 110 includes a reset circuit 111, a compensation circuit 112, and a driving circuit 113. The reset circuit 111 is configured to receive the first sweep signal S1. The reset circuit 111 is configured to reset the first node N1 and the second node N2 according to the first sweep signal S1.

Furthermore, the compensation circuit 112 is connected to the reset circuit 111. The compensation circuit 112 is configured to receive the second sweep signal S2. The compensation circuit 112 is configured to compensate the second node N2 so as to control the driving transistor DT1 to compensate the first node N1 according to the second sweep signal S2.

Then, the driving circuit 113 is connected to the reset circuit 111 and the compensation circuit 112. The driving circuit 113 is configured to receive the EM. The driving circuit 113 is configured to control the driving transistor DT1 so as to drive the light emitting device LED according to the driving signal EM.

In some embodiments, the driving transistor DT1 includes a first end, a second end, and a control end (e.g. a gate terminal of the driving transistor DT1). The first end of the driving transistor DT1 is connected to the first node N1, the second end of the driving transistor DT1 is configured to receive a power supply voltage VSS. The control end of the driving transistor DT1 is connected to the second node N2.

Figure 2:
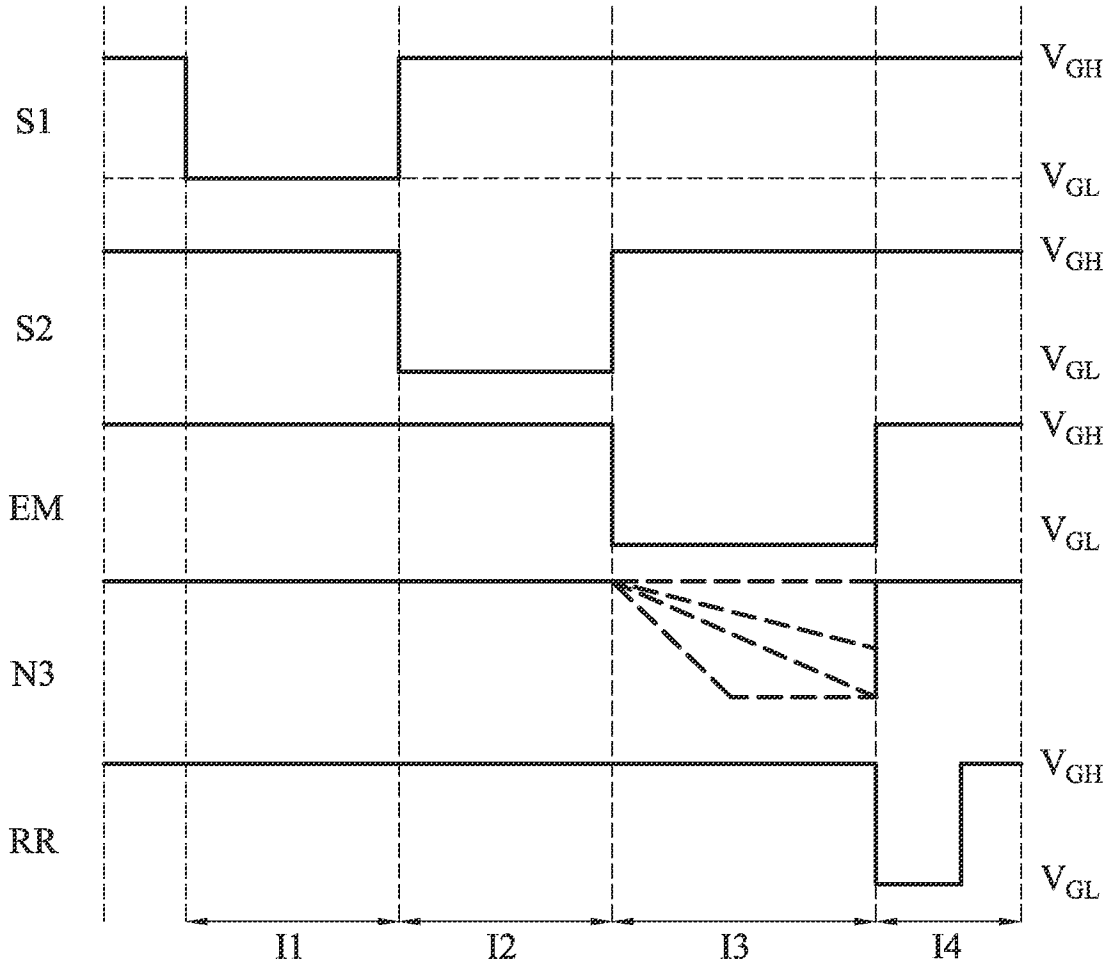
FIG. 2 depicts a schematic diagram of a signal timing of a pixel driving device according to some embodiments of the present disclosure.

In some embodiments, in order to facilitate the understanding of an operation of the pixel driving device 100 shown in FIG. 1, please refer to FIG. 2 together, FIG. 2 depicts a schematic diagram of a signal timing of a pixel driving device 100 according to some embodiments of the present disclosure. The reset circuit 111 is configured to receive the first sweep signal S1 to reset the first node N1 and the second node N2 in a first stage I1. The compensation circuit 112 is configured to compensate the second node N2 so as to control the driving transistor DT1 to compensate the first node N1 according to the second sweep signal S2 in a second stage I2. The driving circuit 113 is configured to control the driving transistor DT1 so as to drive the light emitting device LED according to the driving signal EM in a third stage I3.

In some embodiments, the optical sensor circuit 120 is configured to reset the third node N3 of the optical sensor circuit 120 according to the second sweep signal S2 in the second stage I2. The optical sensor circuit 120 is configured to perform a sensing process so as to generate the light sensing signal in the third stage I3.

In some embodiments, the reset and reading circuit 130 is configured to reset the pixel driving circuit 110 and read out the light sensing signal sensed by the optical sensor circuit 120 in the third stage I3 according to the reset and reading signal RR in a fourth stage I4.

In some embodiments, please refer to FIG. 1, the reset circuit 111 includes the first node N1, a first capacitor C1, a first transistor T1, a second transistor T2, and a third transistor T3. The first capacitor C1 includes a first end and a second end. The first end of the first capacitor C1 is connected to the first node N1.

In addition, please refer to FIG. 1 and FIG. 2, the first transistor T1 includes a first end, a second end, and a control end (e.g. a gate terminal of the first transistor T1). The first end of the first transistor T1 is connected to the second node N2. The second end of the first transistor T1 is configured to receive a first high reference voltage source $V_{REFH}$. The control end of the first transistor T1 is configured to receive the first sweep signal S1 in the first stage I1. The first transistor T1 is configured to reset the second node N2 in response to the first sweep signal S1.

Additionally, the second transistor T2 includes a first end, a second end, and a control end (e.g. a gate terminal of the second transistor T2). The first end of the second transistor T2 is configured to receive a first low reference voltage source $V_{REFH}$. The second end of the second transistor T2 is connected to the second end of the first capacitor C1. The control end of the second transistor T2 is configured to receive the first sweep signal S1 in the first stage I1. The second transistor T2 is configured to reset the second end of the first capacitor C1 in response to the first sweep signal S1.

Furthermore, the third transistor T3 includes a first end, a second end, and a control end (e.g. a gate terminal of the third transistor T3). The first end of the third transistor T3 is configured to receive the first high reference voltage source $V_{REFH}$. The second end of the third transistor T3 is connected to the first node N1. The control end of the third transistor T3 is configured to receive the first sweep signal S1 in the first stage I1. The third transistor T3 is configured to reset the first node N1 in response to the first sweep signal S1.

In some embodiments, please refer to FIG. 1, the compensation circuit 112 includes a fourth node N4, a fourth transistor T4, and a fifth transistor T5. The second end of the first capacitor C1 of the reset circuit 111 is connected to the fourth node N4.

In addition, please refer to FIG. 1 and FIG. 2, the fourth transistor T4 includes a first end, a second end, and a control end (e.g. a gate terminal of the fourth transistor T4). The first end of the fourth transistor T4 is configured to receive a data voltage source $V_{DATA}$. The second end of the fourth transistor T4 is connected to the fourth node N4. The control end of the fourth transistor T4 is configured to receive the second sweep signal S2 in the second stage I2. The fourth transistor T4 is configured to compensate the fourth node N4 in response to the second sweep signal S2. It should be noted that the data voltage source $V_{DATA}$ represents a voltage delivered by a data line of the pixel driving device 100.

Additionally, the fifth transistor T5 includes a first end, a second end, and a control end (e.g. a gate terminal of the fifth transistor T5). The first end of the fifth transistor T5 is configured to receive a first reference voltage source $V_{REF}$. The second end of the fifth transistor T5 is connected to the second node N2. The control end of the fifth transistor T5 is configured to receive the second sweep signal S2 in the second stage I2 The fifth transistor T5 is configured to compensate the second node N2 in response to the second sweep signal S2 in the second stage I2.

In some embodiments, please refer to FIG. 1 and FIG. 2, the driving circuit 113 includes the second node N2 and a sixth transistor T6. The sixth transistor T6 includes a first end, a second end, and a control end (e.g. a gate terminal of the sixth transistor T6). The first end of the sixth transistor T6 is connected to the fourth node N4. The second end of the sixth transistor T6 is connected to second node N2. The control end of the sixth transistor T6 is configured to receive the driving signal EM in the third stage I3. The sixth transistor T6 is configured to control the driving transistor DT1 to drive the light emitting device LED in response to the driving signal EM.

In some embodiments, please refer to FIG. 1 and FIG. 2, the reset and reading circuit 130 includes a first reset transistor T7 and a read transistor T8.

Then, the first reset transistor T7 includes a first end, a second end, and a control end (e.g. a gate terminal of the first reset transistor T7). The first end of the first reset transistor T7 is connected to the second node N2 of the driving circuit 113 of the pixel driving circuit 110. The second end of the first reset transistor T7 is configured to receive the first high reference voltage source $V_{REFH}$. The control end of the first reset transistor T7 is configured to receive the reset and reading signal RR in the fourth stage I4. The first reset transistor T7 is configured to reset the second node N2 of the driving circuit 113 of the pixel driving circuit 110 in response to the reset and reading signal RR.

Furthermore, please refer to FIG. 1 and FIG. 2, the read transistor T8 includes a first end, a second end, and a control end (e.g. a gate terminal of the read transistor T8). The first end of the read transistor T8 is connected to the third node N3 of the optical sensor circuit 120. The second end of the read transistor T8 is connected to a readout line O. The control end of the read transistor T8 is configured to receive the reset and reading signal RR in the fourth stage I4. The read transistor T8 is configured to read out the light sensing signal of the optical sensor circuit 120 in response to the reset and reading signal RR.

In some embodiments, please refer to FIG. 1, the optical sensor circuit 120 is further configured to receive the second sweep signal S2. The optical sensor circuit 120 includes the third node N3, an optical sensor SRO, and a second reset transistor T9.

Then, please refer to FIG. 1 and FIG. 2, the optical sensor SRO includes a first end and a second end. The first end of the optical sensor SRO is connected to the third node N3. The second end of the optical sensor SRO is configured to receive a second reference voltage source $V_{REF_SRO}$. The optical sensor SRO is configured to perform a sensing process so as to generate the light sensing signal in the third stage I3.

Furthermore, the second reset transistor T9 includes a first end, a second end, and a control end (e.g. a gate terminal of the second reset transistor T9). The first end of the second reset transistor T9 is configured to receive the driving signal EM. The second end of the second reset transistor T9 is connected to the third node N3. The control end of the second reset transistor T9 is configured to receive the second sweep signal S2 in the second stage I2. The second reset transistor T9 is configured to reset the third node N3 to a voltage level $V_{GH}$ of the driving signal EM in response to the second sweep signal S2.

In some embodiments, the aforementioned driving transistor DT1, and transistors T1 to T9 includes P-type Metal-Oxide-Semiconductor Field-Effect Transistor (PMOS).

Figure 3:
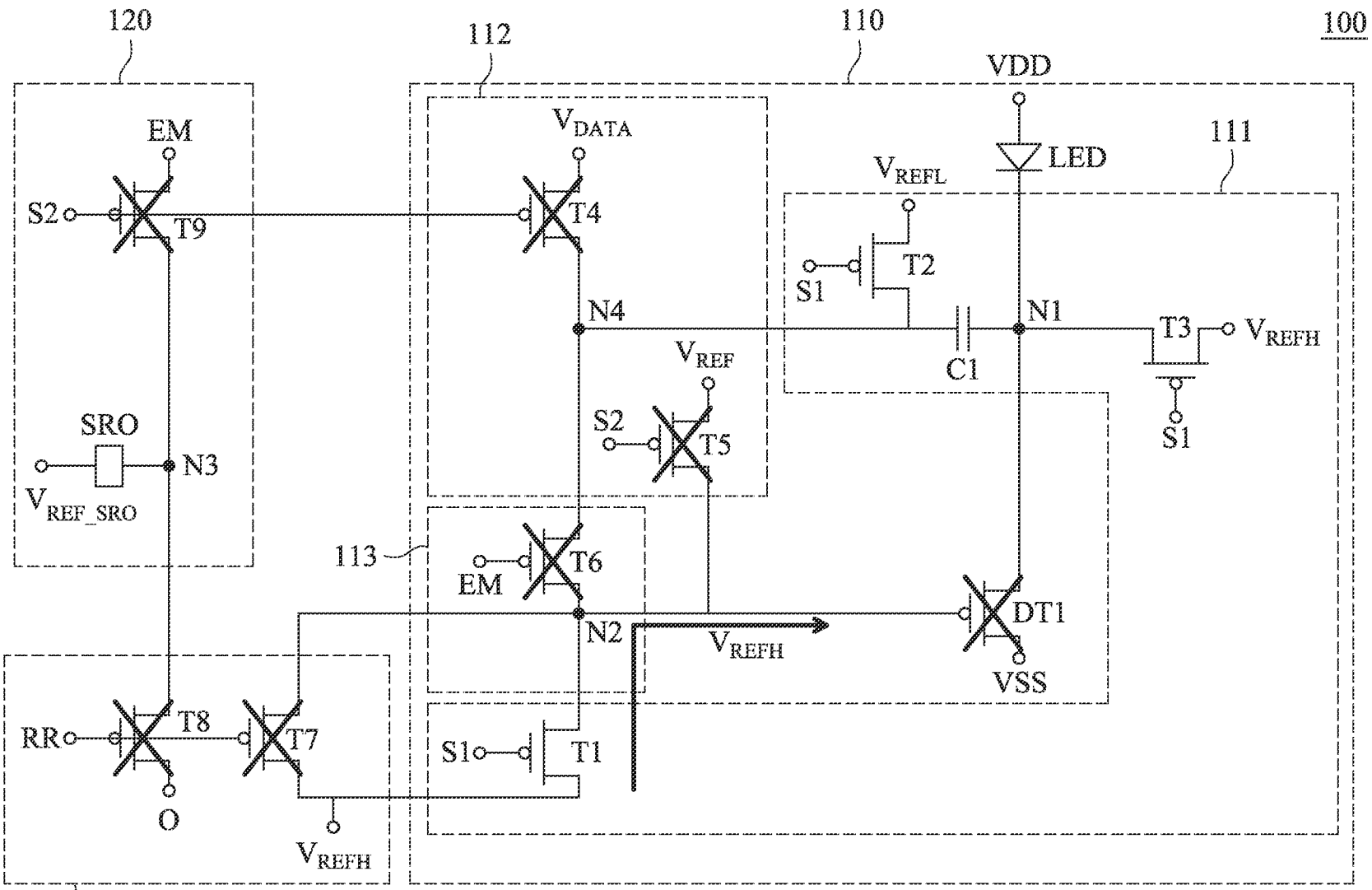
FIG. 3 depicts a schematic diagram of a circuit state of a pixel driving device according to some embodiments of the present disclosure.

FIG. 3 depicts a schematic diagram of a circuit state of a pixel driving device 100 according to some embodiments of the present disclosure. In some embodiments, please refer to FIG. 2 and FIG. 3, in the first stage I1, the first sweep signal S1 is at a low level, and its voltage level is $V_{GA}$. The second sweep signal S2, the driving signal EM, and the reset and reading signal RR is at a high level, and each of their voltage level is $V_{GH}$.

In some embodiments, the first sweep signal S1 writes the voltage level of the first high reference voltage source $V_{REFH}$ to the second node N2 through the first transistor T1 of the reset circuit 111. The control end of the driving transistor DT1 is configured to receive the voltage level of the second node N2. The driving transistor DT1 is turned off in response to the voltage level. The first sweep signal S1 writes the voltage level of a first low reference voltage source $V_{REFL}$ to the second end of the first capacitor C1 (La the fourth node N4) through the second transistor T2. The first sweep signal S1 writes the voltage level of the first high reference voltage source $V_{REFH}$ to the first end of the first capacitor C1 through the third transistor T3.

At this time, a voltage level of the first node N1 is the voltage level of first high reference voltage source $V_{REFH}$. A voltage level of the second node N2 is the voltage level of the first high reference voltage source $V_{REFH}$. A voltage level of the fourth node N4 is the voltage level of the first low reference voltage source $V_{REFL}$.

Figure 4:
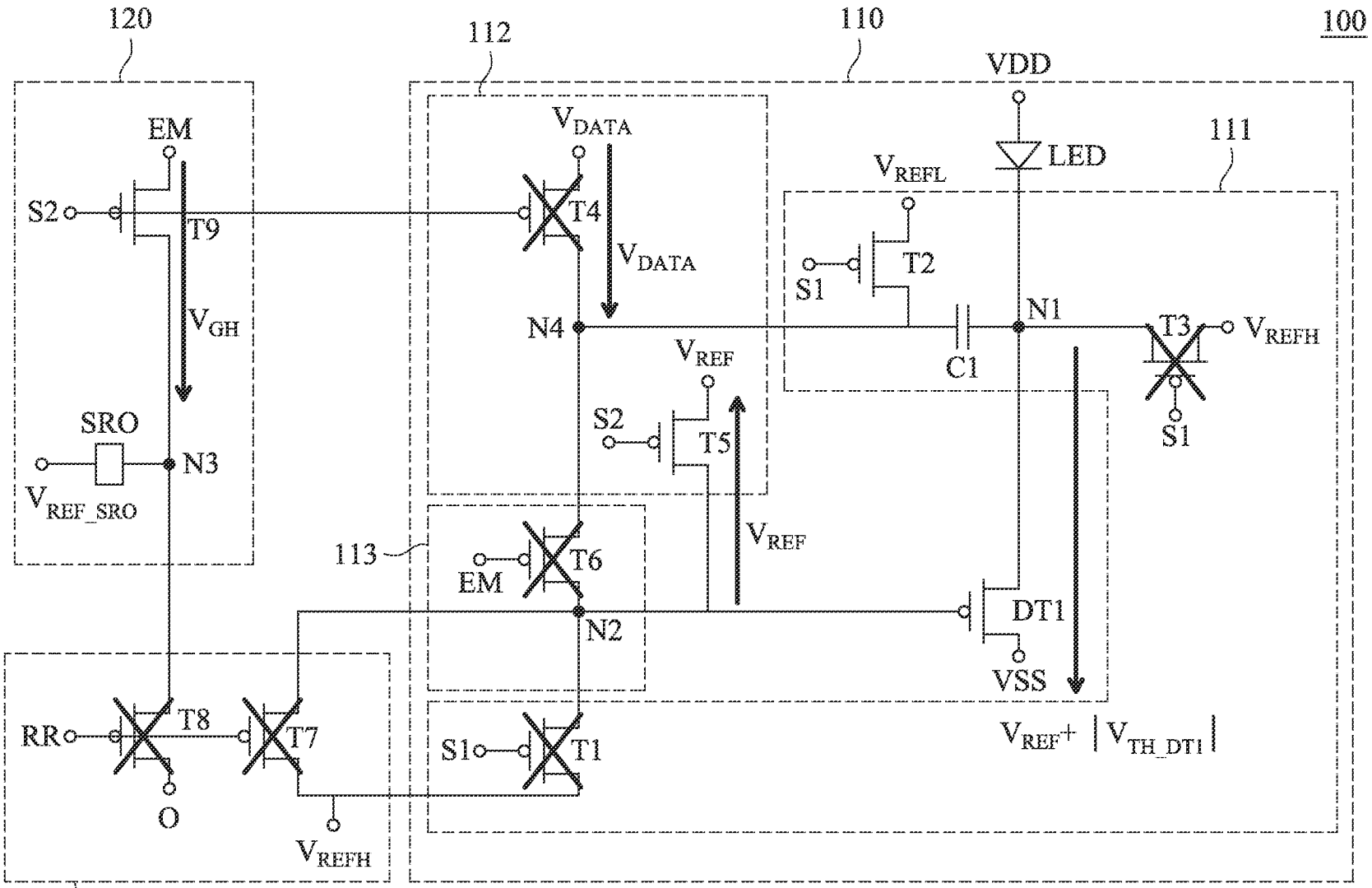
FIG. 4 depicts a schematic diagram of a circuit state of a pixel driving device according to some embodiments of the present disclosure.

FIG. 4 depicts a schematic diagram of a circuit state of a pixel driving device 100 according to some embodiments of the present disclosure. In some embodiments, please refer to FIG. 2 and FIG. 4, in the second stage I2, the second sweep signal S2 is at a low level, and its voltage level is $V_{GL}$. The first sweep signal S1, the driving signal EM, and the reset and reading signal RR is at a high level, and each of their voltage level is $V_{GH}$.

In some embodiments, the second sweep signal S2 writes the voltage level of the data voltage source $V_{DATA}$ to the fourth node N4 through the fourth transistor T4 of the compensation circuit 112. The second sweep signal S2 writes the voltage level of the first reference voltage source $V_{REF}$ to the second node N2 through the fifth transistor T5. Since the voltage level of the second node N2 is discharged to the voltage level of the first reference voltage source $V_{REF}$, the driving transistor DT1 is configure to compensate the first node N1 in response the voltage level of the second node N2.

At the same time, the second sweep signal S2 resets the third node N3 to the voltage level $V_{GH}$ of the driving signal EM through the second reset transistor T9 of the optical sensor circuit 120.

At this time, a voltage level of the first node N1 is the voltage level of the first reference voltage source $V_{REF}$ plus a threshold voltage $V_{TH_DT1}$ of the driving transistor DT1. A voltage level of the second node N2 is the voltage level of reference voltage source $V_{REF}$. A voltage level of the third node N3 is the voltage level $V_{GH}$ of the driving signal EM. A voltage level of the fourth node N4 is the voltage level of the data voltage source $V_{DATA}$.

Figure 5:
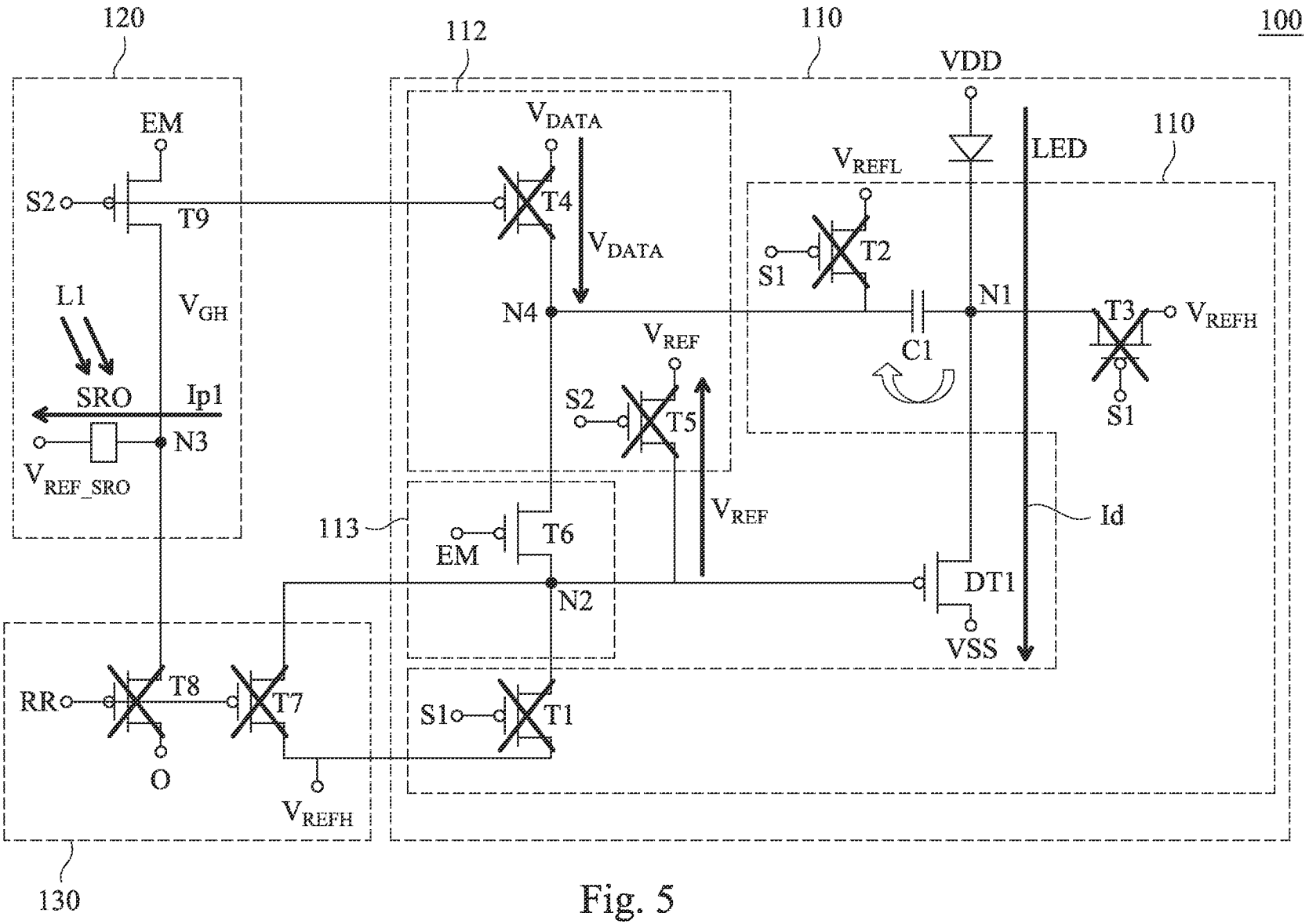
FIG. 5 depicts a schematic diagram of a circuit state of a pixel driving device according to some embodiments of the present disclosure.

FIG. 5 depicts a schematic diagram of a circuit state of a pixel driving device 100 according to some embodiments of the present disclosure. In some embodiments, please refer to FIG. 2 and FIG. 5, the driving signal EM is at a low level, and its voltage level is $V_{GA}$. The first sweep signal S1, the second sweep signal S, and the reset and reading signal RR is at a high level, and each of their voltage level is $V_{GH}$.

In some embodiments, the driving signal EM connects the second node N2 and the fourth node N4 through the sixth transistor T6 and indirectly connects the first node N1 and the second node N2.

In some embodiments, the driving transistor DT1 is turned on according to a voltage difference between the first end and the control end of the driving transistor DT1. The first end of the driving transistor DT1 is equivalent to the first node N1. The control end of the driving transistor DT1 is equivalent to the second node N2. After the sixth transistor T6 is turned on, the driving transistor DT1 is turned on, so that a voltage level of the second node N2 becomes ($V_{REF}$+$|V_{TH_DT1}|$−VSS). The first end of the first capacitor C1 responds to a change of the voltage level of the second node N2, and the second end of the first capacitor C1 senses the first end of the first capacitor C1 to change the fourth node N4 to ($V_{DATA}$+VSS−$V_{REF}$−$|V_{TH_DT1}|$).

In addition, a driving current Id is output according to the voltage difference between the first end and the control end of the driving transistor DT1. The voltage difference between the first end and the control end of the driving transistor DT1 is equivalent to a voltage difference between the fourth node N4 and the second node N2. A formula of the above driving current Id is listed below:

$$Id = \frac{1}{2}K(VSG - Vth)^2 \quad \text{formula 1}$$

In the formula 1, Id is the driving current, VSG is the voltage difference between the first end and the control end of the driving transistor DT1, and Vth is a threshold voltage. In the third stage I3, the voltage level of the control end of the driving transistor DT1 is ($V_{DATA}$+VSS−$V_{REF}$−$|V_{TH_DT1}|$), and the voltage level of the second end of the driving transistor DT1 is VSS. Substitute the voltage level of the control end and the second end of the driving transistor DT1 into the formula 1, a following formula can be obtained:

$$Id = \frac{1}{2}K(VSS - V_{DATA} - VSS + V_{REF} + |V_{TH_DT1}| - |V_{TH_DT1}|)^2 \quad \text{formula 2}$$

In aforementioned formula 2, the same voltage levels cancel each other out, and the formula 2 is rewritten as below:

$$Id = \frac{1}{2}K(V_{REF} - V_{DATA})^2 \quad \text{formula 3}$$

At the same time, please refer to FIG. 2 and FIG. 5, the optical sensor SRO of the optical sensor circuit 120 is configured to perform a sensing process in the third stage I3 to sense a light L1 so as to generate the light sensing signal. It should be noted that a photocurrent Ip1 will generated when the optical sensor SRO generate the light sensing signal. An intensity of the photocurrent Ip1 will affect the voltage level of the third node N3 of the optical sensor circuit 120. The light L1 includes at least one of a specific spectrum and a visible spectrum.

It is further explained that, in the third stage I3, a voltage level of the third node N3 is determined by the intensity of the photocurrent Ip1. Therefore, the voltage level of the third node N3 has various situations. The voltage level of the third node N3 shown in FIG. 2 shows four cases corresponding to four dotted lines respectively. The four dotted lines from top to bottom represent a result of the intensity of the photocurrent Ip1 from weak to strong. When the intensity of the photocurrent Ip1 is stronger, the voltage level of the third node N3 reaches a low voltage lever faster.

Figure 6:
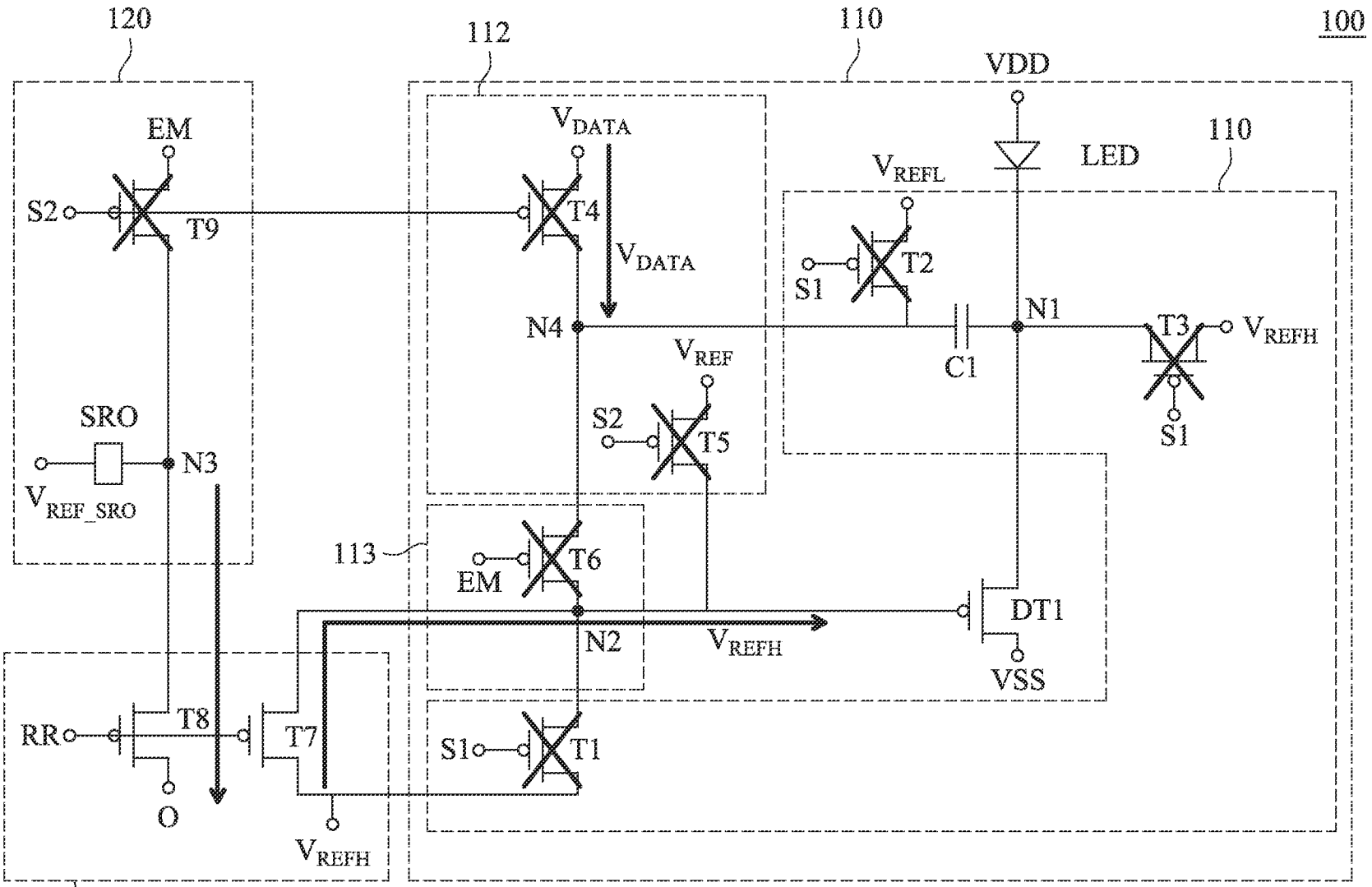
FIG. 6 depicts a schematic diagram of a circuit state of a pixel driving device according to some embodiments of the present disclosure.

FIG. 6 depicts a schematic diagram of a circuit state of a pixel driving device 100 according to some embodiments of the present disclosure. Please refer to FIG. 2 and FIG. 6, the reset and reading signal RR is at a low level, and its voltage level is $V_{GA}$. The first sweep signal S1, the second sweep signal S2, and the driving signal EM is at a high level, and each of their voltage level is $V_{GH}$.

In some embodiments, the reset and reading signal RR writes the voltage level of the first high reference voltage source $V_{REFH}$ to the second node N2 through the first reset transistor T7, and the driving transistor DT1 is turned off in response to the voltage level of the second node N2. The reset and reading signal RR reads out the light sensing signal sensed by the optical sensor SRO of the optical sensor circuit 120 in the third stage I3 through the read transistor T8, and outputs the light sensing signal to the readout line O.

Figure 7:
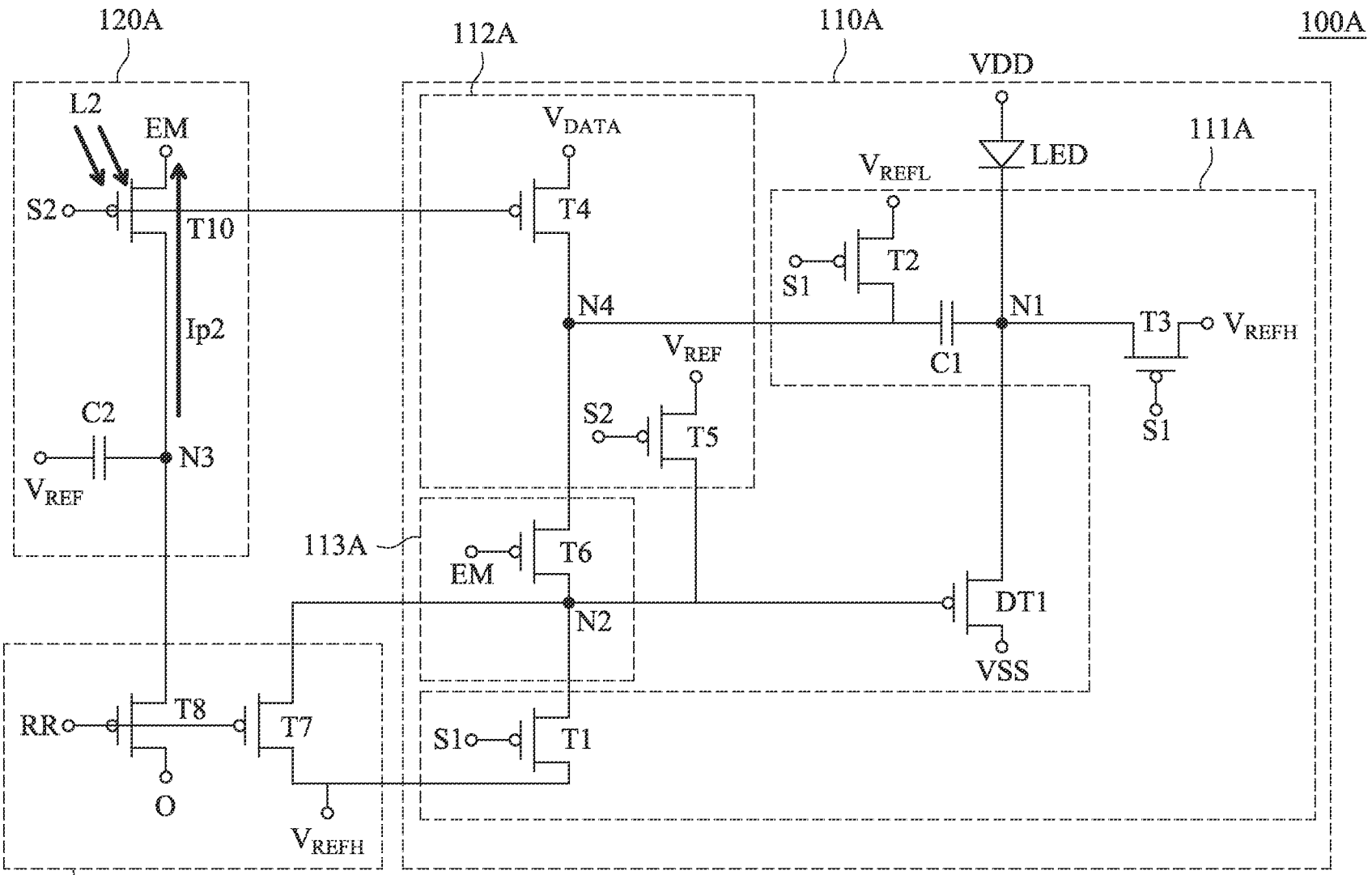
FIG. 7 depicts a schematic diagram of a pixel driving device according to some embodiments of the present disclosure.

FIG. 7 depicts a schematic diagram of a pixel driving device 100A according to some embodiments of the present disclosure. In some embodiments, please refer to FIG. 1 and FIG. 7, compared with FIG. 1, a difference between the embodiment of FIG. 7 and the embodiment of FIG. 1 is that components used in the optical sensor circuit are different, and other circuit structures are the same.

In some embodiments, the optical sensor circuit 120A is further configured to receive the second sweep signal S2. The optical sensor circuit 120A includes the third node N3, a second capacitor C2, and a light sensing transistor T10.

Then, the second capacitor C2 includes a first end and a second end. The first end of the second capacitor C2 is connected to the third node N3. The second end of the second capacitor C2 is configured to receive the first reference voltage source $V_{REF}$.

Furthermore, please refer to FIG. 2 and FIG. 7, the light sensing transistor T10 includes a first end, a second end, and a control end. The first end of the light sensing transistor T10 is configured to receive the driving signal EM. The second end of the light sensing transistor T10 is connected to the third node N3. The control end of the light sensing transistor T10 is configured to receive the second sweep signal S2 in the second stage I2. The light sensing transistor T10 is configured to reset the third node N3 in response to the second sweep signal S2, and the light sensing transistor T10 is configured to perform a sensing process a light L2 in the third stage I3 so as to generate the light sensing signal. While generating the light sensing signal, the light sensing transistor T10 will generate a photocurrent 1*p*2. The light L2 includes at least one of a specific spectrum and a visible spectrum.

In some embodiments, please refer to FIG. 1, the optical sensor circuit 120 includes a first end (e.g. a right side of the optical sensor circuit 120) and a second end (e.g. an underside of the optical sensor circuit 120). The first end of the optical sensor circuit 120 and one end of the pixel driving circuit 110 are connected to a signal source of the second sweep signal S2. The second end of the optical sensor circuit 120 is connected to the reset and reading circuit 130. The reset and reading circuit 130 and another end of the pixel driving circuit 110 are connected to a signal source of the reset and reading signal RR.

In some embodiments, please refer to FIG. 7, the optical sensor circuit 120A includes a first end (e.g. a right side of the optical sensor circuit 120A) and a second end (e.g. an underside of the optical sensor circuit 120A). The first end of the optical sensor circuit 120A and one end of the pixel driving circuit 110A are connected to a signal source of the second sweep signal S2. The second end of the optical sensor circuit 120 is connected to the reset and reading circuit 130. The reset and reading circuit 130A and another end of the pixel driving circuit 110A are connected to a signal source of the reset and reading signal RR.

Figure 8:
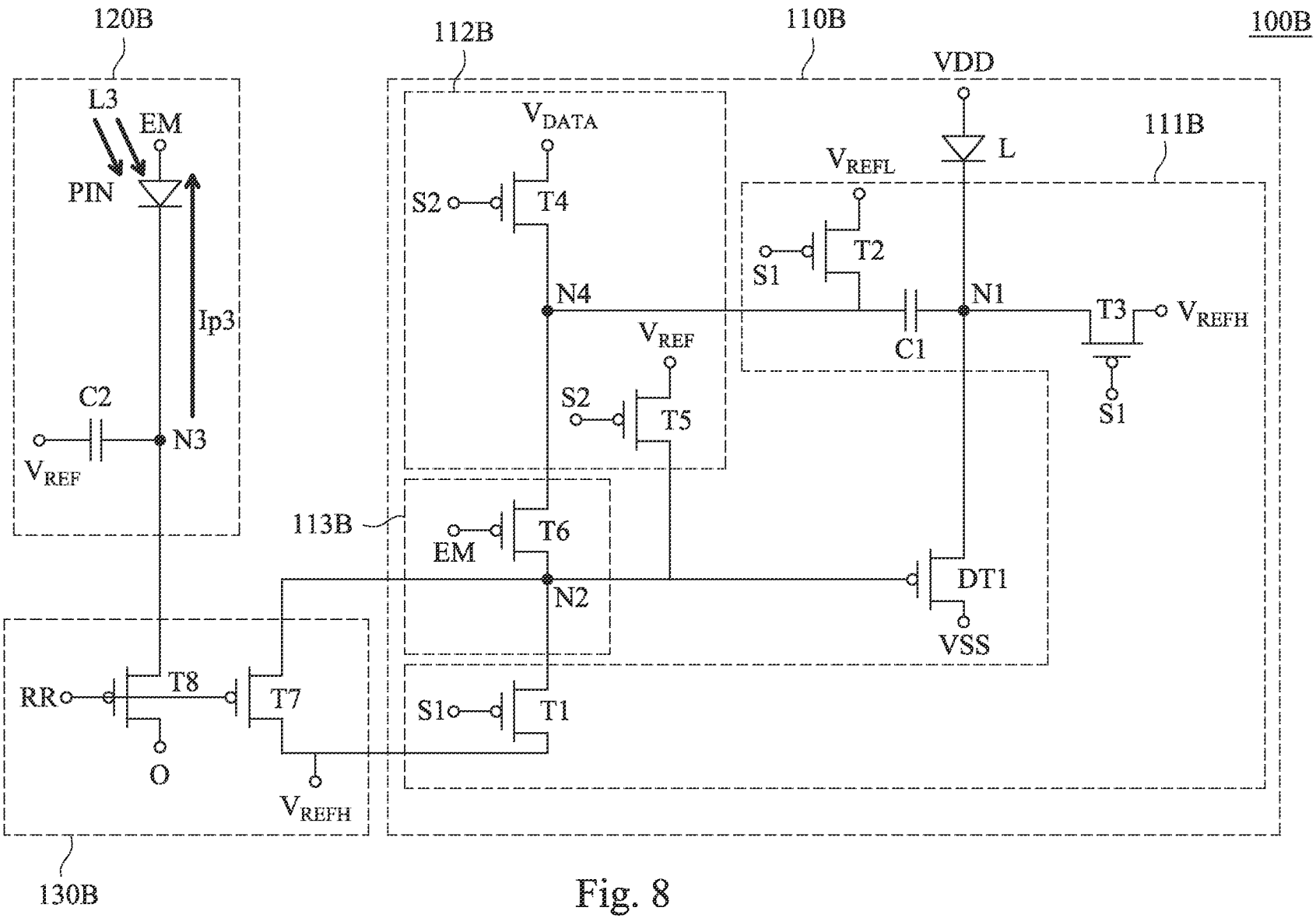
FIG. 8 depicts a schematic diagram of a pixel driving device according to some embodiments of the present disclosure.

FIG. 8 depicts a schematic diagram of a pixel driving device 100B according to some embodiments of the present disclosure. In some embodiments, please refer to FIG. 1 and FIG. 8, compared with FIG. 1, a difference between the embodiment of FIG. 8 and the embodiment of 1 is that components used in the optical sensor circuit are different, the optical sensor circuit 1308 is not connected to a signal source of the second sweep signal S2, and other circuit structures are the same.

In some embodiments, the optical sensor circuit 120B includes the third node N3, a capacitor C3, and a light sensing diode PIN.

Then, the capacitor C3 includes a first end and a second end. The first end of the capacitor C3 is connected to the third node N3. The second end of the capacitor C3 is configured to receive the first reference voltage source $V_{REF}$.

Furthermore, the light sensing diode PIN includes an anode terminal and a cathode terminal. The anode terminal of the light sensing diode PIN is configured to receive the driving signal EM. The cathode terminal of the light sensing diode PIN is connected to the third node N3. The light sensing diode PIN is configured to perform a sensing process a light L3 to generate the light sensing signal. While generating the light sensing signal, the light sensing diode PIN will generate a photocurrent Ip3. The light L3 includes at least one of a specific spectrum and a visible spectrum.

Figure 9:
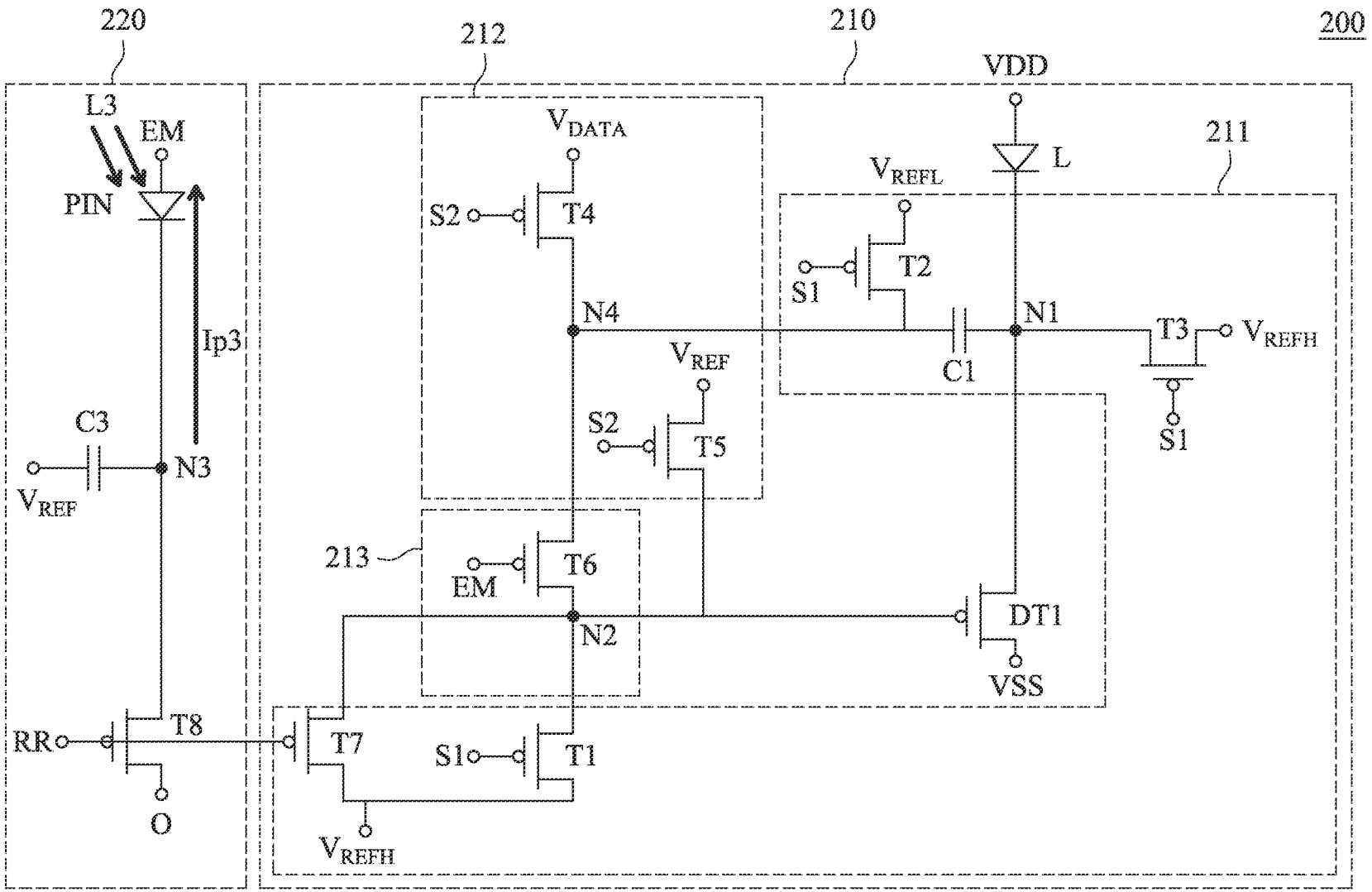
FIG. 9 depicts a schematic diagram of a pixel driving device according to some embodiments of the present disclosure.

FIG. 9 depicts a schematic diagram of a pixel driving device 200 according to some embodiments of the present disclosure. In some embodiments, please refer to FIG. 1, the pixel driving device 200 includes a driving transistor DT1, a pixel driving circuit 210, and optical sensor circuit 220.

In some embodiments, the first end of the driving transistor DT1 is connected to the first node N1. The control end of the driving transistor DT1 is connected to the second node N2. The driving transistor DT1 is configured to control the light emitting device LED.

Then, the pixel driving circuit 210 is configured to receive the first sweep signal S1, the second sweep signal S2, the driving signal EM, and the reset and reading signal RR. The pixel driving circuit 210 is configured to reset the first node N1 and the second node N2 according to the first sweep signal S1. The pixel driving circuit 210 is configured to compensate the second node N2 according to the second sweep signal S2. The pixel driving circuit 210 is configured to control the driving transistor DT1 so as to drive the light emitting device LED according to the driving signal EM. The pixel driving circuit 210 is configured to turn off the driving transistor DT1 according to the reset and reading signal RR.

Furthermore, the optical sensor circuit 220 is connected to the pixel driving circuit 210. The optical sensor circuit 220 is configured to receive the driving signal EM and the reset and reading signal RR. The optical sensor circuit 220 is configured to perform a sensing process so as to generate the light sensing signal. The optical sensor circuit 220 is configured to output the light sensing signal to the readout line O of the pixel driving device 200 according to the reset and reading signal RR.

It should be note that, please refer to FIG. 1, FIG. 7, FIG. 8, and FIG. 9, a difference between the embodiment of FIG. 8 and the embodiment of FIG. 9 is that the transistor T7 in FIG. 9 is divided into the pixel driving circuit 210 and transistor T8 in FIG. 9 is divided into the optical sensor circuit 220, and a rest of structures and circuit operations are similar to the embodiments shown in FIG. 1 and FIG. 8, and omitted herein.

In some embodiments, the pixel driving circuit 210 includes a reset circuit 211, a compensation circuit 212, and a driving circuit 213. The transistor T7 in FIG. 9 is divided into the reset circuit 211 of the pixel driving circuit 210, and a rest of structures and circuit operations are similar to the embodiments shown in 8.

It is further explained that, the embodiment of FIG. 1 and the embodiment of FIG. 7 can also be divided into the pixel driving circuit 210 and the optical sensor circuit 220 as shown in FIG. 9. However, a circuit division method of the present disclosure is not limited to the embodiment of the present disclosure.

Then, please refer to FIG. 2 and FIG. 9, since the transistor T7 is divided into the pixel driving circuit 210, the pixel driving circuit 210 performs additional operations in the fourth stage I4 to reset the second node N2, thereby turning off the driving transistor DT1.

Furthermore, please refer to FIG. 2 and FIG. 9, since the transistor T8 is divided into the optical sensor circuit 220, the optical sensor circuit 220 performs additional operations in the fourth stage I4 to read out the light sensing signal sensed by the optical sensor circuit 220 in the third stage I3.

In some embodiments, the optical sensor circuit 220 and the pixel driving circuit 210 are connected to a signal source of the reset and reading signal RR.

In some embodiments, please refer to FIG. 1, FIG. 3 to FIG. 9, each of the compensation circuits in the aforementioned embodiments is connected to a data line of the pixel driving device (e.g. a location of the data voltage source $V_{DATA}$). Each of the compensation circuits in the aforementioned embodiments is configured to receive a voltage of the data line. Each of the compensation circuits in the aforementioned embodiments is configured to compensate the second node N2 to the voltage of the first reference voltage source $V_{REF}$ according to the second sweep signal S2.

In some embodiments, a direction of the signal transmitted by the data line (e.g. a location of the data voltage source $V_{DATA}$) and a direction of the signal transmitted by the readout line O are the same direction.

Based on the above embodiments, the present disclosure provides a pixel driving device to reduce a voltage difference between two power supply voltages so as to reduce power consumption, and an optical sensor is added so that a pixel driving device can sense and display at the same time.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims.

What is claimed is:

1. A pixel driving device, comprising:

a driving transistor, wherein a first end of the driving transistor is connected to a first node, a control end of the driving transistor is connected to a second node, and the driving transistor is configured to control a light emitting device;

a pixel driving circuit, coupled to the driving transistor, the first node, and the second node, and configured to receive a first sweep signal, a second sweep signal, and a driving signal, wherein the pixel driving circuit is configured to reset the first node and the second node according to the first sweep signal, the pixel driving circuit is configured to compensate the second node according to the second sweep signal, and the pixel driving circuit is configured to control the driving transistor so as to drive the light emitting device according to the driving signal;

an optical sensor circuit, comprising a third node, wherein the optical sensor circuit is configured to receive the driving signal to reset the third node to a voltage level of the driving signal, wherein the optical sensor circuit is configured to perform a sensing process to generate a light sensing signal; and a reset and reading circuit, connected to the pixel driving circuit, the optical sensor circuit, and the control end of the driving transistor, wherein the reset and reading circuit is configured to receive a reset and reading signal so as to reset the pixel driving circuit and read out the light sensing signal of the optical sensor circuit at a same time.

2. The pixel driving device of claim 1, wherein the pixel driving circuit comprises:

a reset circuit, configured to receive the first sweep signal, wherein the reset circuit is configured to reset the first node and the second node according to the first sweep signal;

a compensation circuit, connected to the reset circuit, wherein the compensation circuit is configured to receive the second sweep signal, and the compensation circuit is configured to compensate the second node so as to control the driving transistor to compensate the first node according to the second sweep signal; and a driving circuit, connected to the reset circuit and the compensation circuit, and configured to receive the driving signal, wherein the driving circuit is configured to control the driving transistor so as to drive the light emitting device according to the driving signal.

3. The pixel driving device of claim 2, wherein the reset circuit comprises:

the first node; and a first capacitor, comprising a first end and a second end, wherein the first end of the first capacitor is connected to the first node.

4. The pixel driving device of claim 3, wherein the reset circuit further comprises:

a first transistor, comprising a first end, a second end, and a control end, wherein the first end of the first transistor is connected to the second node, wherein the second end of the first transistor is configured to receive a first high reference voltage source, wherein the control end of the first transistor is configured to receive the first sweep signal in a first stage, and the first transistor is configured to reset the second node in response to the first sweep signal;

a second transistor, comprising a first end, a second end, and a control end, wherein the first end of the second transistor is configured to receive a first low reference voltage source, wherein the second end of the second transistor is connected to the second end of the first capacitor, wherein the control end of the second transistor is configured to receive the first sweep signal in the first stage, and the second transistor is configured to reset the second end of the first capacitor in response to the first sweep signal; and a third transistor, comprising a first end, a second end, and a control end, wherein the first end of the third transistor is configured to receive the first high reference voltage source, wherein the second end of the third transistor is connected to the first node, wherein the control end of the third transistor is configured to receive the first sweep signal in the first stage, and the third transistor is configured to reset the first node in response to the first sweep signal.

5. The pixel driving device of claim 4, wherein the compensation circuit comprises:

a fourth node, wherein the second end of the first capacitor is connected to the fourth node;

a fourth transistor, comprising a first end, a second end, and a control end, wherein the first end of the fourth transistor is configured to receive a data voltage source, wherein the second end of the fourth transistor is connected the fourth node, wherein the control end of the fourth transistor is configured to receive the second sweep signal in a second stage, and the fourth transistor is configured to compensate the fourth node in response to the second sweep signal; and a fifth transistor, comprising a first end, a second end, and a control end, wherein the first end of the fifth transistor is configured to receive a first reference voltage source, wherein the second end of the fifth transistor is connected to the second node, wherein the control end of the fifth transistor is configured to receive the second sweep signal in the second stage, and the fifth transistor is configured to compensate the second node in response to the second sweep signal.

6. The pixel driving device of claim 5, wherein the driving circuit comprises:

the second node; and a sixth transistor, comprising a first end, a second end, and a control end, wherein the first end of the sixth transistor is connected to the fourth node, wherein the second end of the sixth transistor is connected to the second node, wherein the control end of the sixth transistor is configured to receive the driving signal in a third stage, and the sixth transistor is configured to control the driving transistor to drive the light emitting device in response to the driving signal.

7. The pixel driving device of claim 6, wherein the reset and reading circuit comprises:

a first reset transistor, comprising a first end, a second end, and a control end, wherein the first end of the first reset transistor is connected to the second node of the driving circuit of the pixel driving circuit, wherein the second end of the first reset transistor is configured to receive the first high reference voltage source, wherein the control end of the first reset transistor is configured to receive the reset and reading signal in a fourth stage, and the first reset transistor is configured to reset the second node of the driving circuit of the pixel driving circuit in response to the reset and reading signal; and a read transistor, comprising a first end, a second end, and a control end, wherein the first end of the read transistor is connected to the third node of the optical sensor circuit, wherein the second end of the read transistor is connected to a readout line, wherein the control end of the read transistor is configured to receive the reset and reading signal in the fourth stage, and the read transistor is configured to read the light sensing signal of the optical sensor circuit in response to the reset and reading signal.

8. The pixel driving device of claim 7, wherein the optical sensor circuit is further configured to receive the second sweep signal, wherein the optical sensor circuit comprises:

the third node;

an optical sensor, comprising a first end and a second end, wherein the first end of the optical sensor is connected to the third node, wherein the second end of the optical sensor is configured to receive a second reference voltage source, and the optical sensor is configured to perform a sensing process to generate the light sensing signal in the third stage; and a second reset transistor, comprising a first end, a second end, and a control end, wherein the first end of the second reset transistor is configured to receive the driving signal, wherein the second end of the second reset transistor is connected to the third node, wherein the control end of the second reset transistor is configured to receive the second sweep signal in the second stage, and the second reset transistor is configured to reset the third node to a voltage level of the driving signal in response to the second sweep signal.

9. The pixel driving device of claim 7, wherein the optical sensor circuit is configured to receive the second sweep signal, wherein the optical sensor circuit comprises:

the third node;

a second capacitor, comprising a first end and a second end, wherein the first end of the second capacitor is connected to the third node, wherein the second end of the second capacitor is configured to receive the first reference voltage source; and a light sensing transistor, comprising a first end, a second end, and a control end, wherein the first end of the light sensing transistor is configured to receive the driving signal, wherein the second end of the light sensing transistor is connected to the third node, wherein the control end of the light sensing transistor is configured to receive the second sweep signal in the second stage, the light sensing transistor is configured to reset the third node in response to the second sweep signal, and the light sensing transistor is configured to perform a sensing process to generate the light sensing signal in the third stage.

10. The pixel driving device of claim 7, wherein the optical sensor circuit comprise:

the third node;

a second capacitor, comprising a first end and a second end, wherein the first end of the second capacitor is connected to the third node, wherein the second end of the second capacitor is configured to receive the first reference voltage source; and a light sensing diode, comprising an anode terminal and a cathode terminal, wherein the anode terminal of the light sensing diode is configured to receive the driving signal, wherein the cathode terminal of the light sensing diode is connected to the third node, and the light sensing diode is configured to perform a sensing process to generate the light sensing signal.

11. The pixel driving device of claim 1, wherein the optical sensor circuit comprises a first end and a second end, wherein the first end of the optical sensor circuit and one end of the pixel driving circuit are connected to a signal source of the second sweep signal, wherein the second end of the optical sensor circuit is connected to the reset and reading circuit.

12. A pixel driving device, comprising:

a driving transistor, wherein a first end of the driving transistor is connected to a first node, a control end of the driving transistor is connected to a second node, and the driving transistor is configured to control a light emitting device;

a pixel driving circuit, configured to receive a first sweep signal, a second sweep signal, a driving signal, and a reset and reading signal, wherein the pixel driving circuit is configured to reset the first node and the second node according to the first sweep signal, the pixel driving circuit is configured to compensate the second node according to the second sweep signal, the pixel driving circuit is configured to control the driving transistor so as to drive the light emitting device according to the driving signal, and the pixel driving circuit is configured to turn off the driving transistor according to the reset and reading signal; and an optical sensor circuit, connected to the pixel driving circuit, wherein the optical sensor circuit is configured to receive the driving signal and the reset and reading signal, wherein the optical sensor circuit is configured to perform a sensing process so as to generate a light sensing signal, and the optical sensor circuit is configured to output the light sensing signal to a readout line of the pixel driving device according to the reset and reading signal.

13. The pixel driving device of claim 12, wherein the optical sensor circuit comprises:

a third node;

a capacitor, comprising a first end and a second end, wherein the first end of the capacitor is connected the third node, wherein the second end of the capacitor is configured to receive a reference voltage source;

a light sensing diode, comprising an anode terminal and a cathode terminal, wherein the anode terminal of the light sensing diode is configured to receive the driving signal, wherein the cathode terminal of the light sensing diode is connected to the third node, the light sensing diode is configured to perform a sensing process so as to generate the light sensing signal; and a first transistor, comprising a first end, a second end, and a control end, wherein the first end of the first transistor is connected to the cathode terminal of the light sensing diode, wherein the second end of the first transistor is connected to the readout line, wherein the control end of the first transistor is configured to receive the reset and reading signal, the first transistor is configured to output the light sensing signal in response to the reset and reading signal.

14. The pixel driving device of claim 12, wherein the pixel driving circuit comprises:

a reset circuit, configured to receive the first sweep signal and the reset and reading signal, wherein the reset circuit is configured to reset the first node and the second node according to the first sweep signal, and the reset circuit is configured to turn off the driving transistor according to the reset and reading signal.

15. The pixel driving device of claim 14, wherein the reset circuit comprises:

a second transistor, comprising a first end, a second end, and a control end, wherein the first end of the second transistor is connected to the second node, wherein the second end of the second transistor is configured to receive a first high reference voltage source, wherein the control end of the second transistor is configured to receive the first sweep signal, wherein the second transistor is configured to reset the second node in response to the first sweep signal; and a third transistor, comprising a first end, a second end, and a control end, wherein the first end of the third transistor is connected to the second node, wherein the second end of the third transistor is configured to receive the first high reference voltage source, wherein the control end of the third transistor is configured to receive the reset and reading signal, wherein the third transistor is configured to reset the second node to turn off the driving transistor in response to the reset and reading signal.

16. The pixel driving device of claim 14, wherein the pixel driving circuit further comprises:

a compensation circuit, connected to the reset circuit, wherein the compensation circuit is configured to receive the second sweep signal, and the compensation circuit is configured to compensate the second node so as to control the driving transistor to compensate the first node according to the second sweep signal.

17. The pixel driving device of claim 16, wherein the compensation circuit is connected to a data line of the pixel driving device, the compensation circuit is configured to receive a data voltage of the data line, and the compensation circuit is configured to compensate the second node to a voltage level of a reference voltage source according to the second sweep signal.

18. The pixel driving device of claim 17, wherein a direction of the signal transmitted by the data line and a direction of the signal transmitted by the readout line are a same direction.

19. The pixel driving device of claim 16, wherein the pixel driving circuit further comprises:

a driving circuit, connected to the reset circuit and the compensation circuit, and configured to receive the driving signal, wherein the driving circuit is configured to control the driving transistor so as to drive the light emitting device according the driving signal.

20. The pixel driving device of claim 12, wherein the optical sensor circuit and the pixel driving circuit are connected to a signal of the reset and reading signal.

* * * * *